US010256015B2

(12) United States Patent
Miwa et al.

(10) Patent No.: US 10,256,015 B2
(45) **Date of Patent: *Apr. 9, 2019**

(54) R-T-B BASED SINTERED MAGNET AND ROTATING MACHINE

(71) Applicant: TDK Corporation, Tokyo (JP)

(72) Inventors: Masashi Miwa, Tokyo (JP); Haruna Nakajima, Tokyo (JP); Isao Kanada, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/906,682

(22) PCT Filed: Aug. 8, 2014

(86) PCT No.: PCT/JP2014/070968
§ 371 (c)(1),
(2) Date: Jan. 21, 2016

(87) PCT Pub. No.: WO2015/020180
PCT Pub. Date: Feb. 12, 2015

(65) Prior Publication Data

US 2016/0163435 A1 Jun. 9, 2016

(30) Foreign Application Priority Data

Aug. 9, 2013 (JP) ..... 2013-166356

(51) Int. Cl.
*H01F 1/059* (2006.01)
*H01F 1/053* (2006.01)
(Continued)

(52) U.S. Cl.
CPC ..... *H01F 1/0536* (2013.01); *H01F 1/0577* (2013.01); *H01F 41/0293* (2013.01)

(58) Field of Classification Search
None
See application file for complete search history.

(56) References Cited

U.S. PATENT DOCUMENTS 5,641,363 A 6/1997 Fukuno et al.
5,834,663 A 11/1998 Fukuno et al.
(Continued)

FOREIGN PATENT DOCUMENTS

CN 1495815 A 5/2004
JP H04-6806 A 1/1992
(Continued)

OTHER PUBLICATIONS

Katter et al. (IEEE Transactions on Magnetics, 2001, vol. 37, p. 2474-2476).*
(Continued)

*Primary Examiner* — Xiaowei Su
(74) *Attorney, Agent, or Firm* — Oliff PLC

(57) ABSTRACT

The present invention provides an R-T-B based sintered magnet having excellent corrosion resistance together with good magnetic properties. The R-T-B based sintered magnet contains $R_2T_{14}B$ crystal grains, wherein, an R—Ga—Co—Cu—N concentrated part exists in a grain boundary formed between or among two or more adjacent $R_2T_{14}B$ crystal grains, and the concentrations of R, Ga, Co, Cu and N in the R—Ga—Co—Cu—N concentrated part are higher than those in the $R_2T_{14}B$ crystal grains respectively.

2 Claims, 3 Drawing Sheets

(51) Int. Cl.
*H01F 1/057* (2006.01)
*H01F 41/02* (2006.01)

(56) References Cited

U.S. PATENT DOCUMENTS

| | | | | |
|---|---|---|---|---|
| 5,858,123 | A | 1/1999 | Uchida et al. | |
| 5,997,804 | A | 12/1999 | Uchida et al. | |
| 6,080,245 | A | 6/2000 | Uchida et al. | |
| 2004/0177899 | A1 | 9/2004 | Nishizawa et al. | |
| 2005/0067058 | A1* | 3/2005 | Fujimori | C22C 38/005 148/302 |
| 2006/0201585 | A1* | 9/2006 | Tomizawa | C22C 33/0278 148/302 |
| 2011/0279205 | A1 | 11/2011 | Fukui et al. | |
| 2012/0024429 | A1 | 2/2012 | Hayakawa et al. | |
| 2013/0092868 | A1* | 4/2013 | Nakajima | C22C 38/005 252/62.51 R |
| 2016/0042848 | A1* | 2/2016 | Kuniyoshi | C22C 38/002 75/246 |
| 2016/0180993 | A1* | 6/2016 | Kanada | C22C 38/00 252/62.55 |
| 2016/0225502 | A1* | 8/2016 | Miwa | H01F 1/0577 |

FOREIGN PATENT DOCUMENTS

| | | | | |
|---|---|---|---|---|
| JP | H04-330702 | A | 11/1992 | |
| JP | H07-272914 | A | 10/1995 | |
| JP | 2006-165008 | A | 6/2006 | |
| JP | 2011-210823 | A | 10/2011 | |
| JP | 2011-258935 | A | 12/2011 | |
| JP | 2012-028704 | A | 2/2012 | |
| WO | 2004/029995 | A1 | 4/2004 | |
| WO | WO 2012002060 | A1 * | 1/2012 | C22C 38/005 |

OTHER PUBLICATIONS

Oct. 7, 2014 Written Opinion issued in International Patent Application No. PCT/JP2014/070968.

* cited by examiner

R-T-B BASED SINTERED MAGNET AND ROTATING MACHINE

The present invention relates to an R-T-B based sintered magnet having a rare earth element (R), at least one kind of transition metal element (T) with Fe or the combination of Fe and Co as the necessity, and Boron (B) as its main components. The present invention also relates to a rotating machine provided with the R-T-B based sintered magnet.

BACKGROUND

Although the R-T-B (R represents one or more kinds of rare earth elements and T represents one or more kinds of transition metal elements with Fe or the combination of Fe and Co as the necessity) based sintered magnet shows excellent magnetic properties, it tends to have a had corrosion resistance due to an inclusion of the rare earth element as the main component which is easily oxidized.

Therefore, in order to improve the corrosion resistance of the R-T-B based sintered magnet, the surface of the magnet body is generally treated by, for example, resin coating, plating or the like. On the other hand, the additive elements or the internal structure of the magnet body can be changed to improve the corrosion resistance of the magnet body itself. The improvement of the corrosion resistance in the magnet body itself is extremely important to heighten the reliability of a product that has been subjected to a surface treatment. Besides, said improvement may thereby allow a surface treatment simpler than the resin coating or plating, which is advantageous for reducing the cost of the product.

Conventionally, for instance, patent document 1 has suggested a technique to improve the corrosion resistance of a magnet by reducing the carbon content in a permanent magnet alloy to 0.4 mass % or less and inhibiting the intermetallics R—C of the rare earth element and carbon in a non-magnetic R-rich phase to 1.0 mass % or less. In addition, patent document 2 has proposed a technique to improve the corrosion resistance by setting the concentration of Co in an R-rich phase at 5 mass % to 12 mass %.

However, in the conventionally used R-T-B based sintered magnet, water such as water vapor in the environment oxidizes R in the R-T-B based sintered magnet to generate hydrogen. Then, the R-rich phase in grain boundary absorbs the hydrogen, resulting in corrosion of the R-rich phase. In this way, the magnetic properties deteriorate in the R-T-B based sintered magnet.

In addition, as suggested in patent document 1, in order to reduce the carbon content in the magnet alloy to 0.04 mass % or less, it is necessary to greatly reduce the amount of the lubricant added to improve the magnetic field orientation when the magnet is pressed in a magnetic field. Therefore, the orientation degree of the magnetic powders in a green compact decreases and the residual magnetic flux density Br after sintering also decreases so that it is not possible to obtain a magnet having sufficient magnetic properties.

On the other band, as suggested in patent document 2, it is necessary to increase the content of Co in the raw material so as to increase the Co concentration in an R-rich phase. However, since Co also enters the main phase of $R_2T_{14}B$ phase to substitute Fe, it cannot be achieved to increase the Co concentration only in the R-rich phase. More Co should be added than that as needed in the R-rich phase. Therefore, production cost rises as the amount of the expensive Co in use increases, and magnetic properties deteriorate as Fe in the main phase is substituted with Co at a level more than that as needed.

PATENT DOCUMENTS

Patent document 1: JP-A-H4-330702
Patent document 2: JP-A-H4-6806

SUMMARY

The present invention has been made by considering the above conditions, and the object of the present invention is to provide an R-T-B based sintered magnet having an excellent corrosion resistance and good magnetic properties. The present invention also aims to provide a rotating machine having this R-T-B based sintered magnet.

In order to achieve the object, the present inventors have pursued extensive studies about a mechanism of the R-T-B based sintered magnet corrosion. As a result, they have bond the followings. First, hydrogen ($H_2$) is produced by corrosion reaction between water such as water vapor under a use environment and "R" in the R-T-B based sintered magnet. The hydrogen is stored in an R-rich phase present in a grain boundary in the R-T-B based sintered magnet, which accelerates change of an R-rich phase to hydroxide. And then, a crystal grain (a maw phase grain) constituting a main phase of the R-T-B based sintered magnet fills off from the R-T-B based sintered magnet, and a corrosion of "R" progresses inside the R-T-B based sintered magnet at an accelerated pace, due to a volume expansion of the R-T-B based sintered magnet associated with the hydrogen storage in the R-rich phase and the change of the R-rich phase to hydroxide.

Therefore, the present inventors have pursued extensive studies about the method for preventing hydrogen storage in the grain boundary. And they have found that the hydrogen can be prevented from being stored to the grain boundary by forming an R—Ga—Co—Cu—N concentrated part in a grain boundary formed between or among to or more adjacent $R_2T_{14}B$ crystal grains (particularly a triple junction formed among three or more adjacent $R_2T_{14}B$ crystal grains) in the R-T-B based sintered magnet, wherein the concentrations of a rare earth element (R), gallium (Ga), cobalt (Co), copper (Cu) and nitrogen (N) in the R—Ga—Co—Cu—N concentrated part are all higher than those in the $R_2T_{14}B$ crystal grains respectively, in this way, the corrosion resistance of the R-T-B based sintered magnet can be improved to a large extent and reed magnetic properties can be provided. The present invention has been made based on the above findings.

The R-T-B based sintered magnet according to the present invention is characterized in that it contains $R_2T_{14}B$ crystal grains, wherein, an R—Ga—Co—Cu—N concentrated part exists in a grain boundary formed between or among two or more adjacent $R_2T_{14}B$ crystal grains, and the concentrations of R, Ga, Co, Cu and N in the R—Ga—Co—Cu—N concentrated pail are all higher than those in the $R_2T_{14}B$ crystal grains respectively.

The R—Ga—Co—Cu—N concentrated part refers to an area where the concentrations of R, Ga, Co, Cu and N existed in the grain boundary are all higher than those in the $R_2T_{14}B$ crystal grains, respectively. In addition, such an area exists in the grain boundary formed between or among two or more adjacent crystal grains.

In the present invention, with the R—Ga—Co—Cu—N concentrated part in the grain boundary, the hydrogen generated in the corrosion reaction can be effectively prevented from being stored to the grain boundary and the inner progress of the corrosion of R can be prevented. In this way, the corrosion resistance of the R-T-B based sintered magnet can be largely improved and good magnetic properties can be provided. Further, the R-rich phase is defined as a grain boundary phase where R is higher than that in $R_2T_{14}B$ crystal grains in content but at least N in Ga, Co, Cu and N is equal to or less than that in $R_2T_{14}B$ crystal grains in content.

The present invention also provides a rotating machine having the R-T-B based sintered magnet of the present invention. Since the rotating machine of the present invention contains the R-T-B based sintered magnet mentioned above, it will possess excellent performance in a long term even used in a severe conditions with high humidity because little corrosion was caused by the rust, or the like in the R-T-B based sintered magnet.

According to the present invention, an R-T-B based sintered magnet having excellent corrosion resistance and good magnetic properties can be provided. In addition, according to the present invention, a rotating machine can be provided. With the R-T-B based sintered magnet, the rotating machine keeps excellent performance in a long term even in an environment with a high temperature and a high humidity.

DETAILED DESCRIPTION OF EMBODIMENTS

Figure 1:
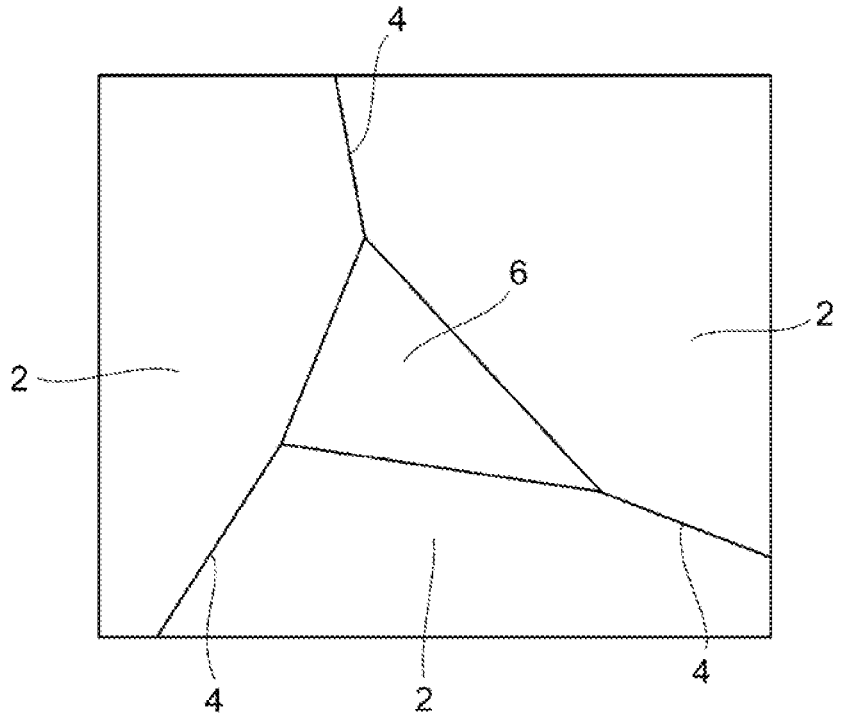
FIG. 1 is a schematic back-scattered-electron image showing the vicinity of grain boundary formed between or among a plurality of $R_2T_{14}B$ crystal grains in the R-T-B based sintered magnet of the present invention.

Hereinafter, the present invention will be described based on the embodiments shown in the drawings.

<R-T-B Based Sintered Magnet>

The embodiments of the R-T-B based sintered magnet in the embodiment of the present invention will be described. As shown in FIG. 1, the R-T-B based sintered magnet of the present embodiment contains a grain (main phase) 2 composed of $R_2T_{14}B$ crystal grains, and an R—Ga—Co—Cu—N concentrated part exists in the grain boundary formed between or among two or more adjacent $R_2T_{14}B$ crystal grains 2 with the concentrations of R, Ga, Co, Cu and N in the R—Ga—Co—Cu—N concentrated part being higher than those in the $R_2T_{14}B$ crystal grains respectively.

The grain boundary includes a two-grain boundary 4 formed between two adjacent $R_2T_{14}B$ crystal grains and a triple junction (formed among three or more adjacent $R_2T_{14}B$ crystal grains. In addition, the R—Ga—Co—Cu—N concentrated part refers to an area which exists in a grain boundary formed between or among two or more adjacent crystal grains with the concentration of R, Ga, Co, Cu and N each being higher than that in the $R_2T_{14}B$ crystal grains. In the R—Ga—Co—Cu—N concentrated part, as long as R, Ga, Co, Cu and N are included, as the main components, other components may be included.

The R-T-B based sintered magnet according to the present embodiment is a sintered body formed by using an R-T-B based alloy. The R-T-B based sintered magnet according to the present embodiment comprises a math phase with the composition of the crystal grains containing $R_2T_{14}B$ compound and a gain boundary having more R than the $R_2T_{14}B$ compound, wherein the $R_2T_{14}B$ compound can be represented by the formula of $R_2T_{14}B$ (R represents at least one rare earth element, T represents at least one transition metal element with Fe or the combination of Fe and Co as the necessity, and B represents B or the combination of B and C).

R represents at least one rare earth element. The rare earth element refers to Sc, Y and lanthanoid elements, which belong to the third group of a long period type periodic table. The lanthanoid element includes La, Ce, Pr, Nd, Sm, Eu, Gd, Tb, Dy, Ho, Er, Tm, Yb, Lu and the like. The rare earth element is classified as the light rare earth and the heavy rare earth. The heavy rare earth element (hereinafter also referred to as RH) includes Gd, Tb, Dy, Ho, Er, Tm, Yb and Lu while the light rare earth element (hereinafter referred to as RL) includes the other rare earth elements. According to the present embodiment, R is preferable to include RL (the rare earth element including at least either or both of Nd and Pr) in view of production cost and magnetic properties. Further, R may also include both RL (the rare earth element including at least either or both of Nd and Pr) and RH (the rare earth element including at least either or both of Dy and Tb) in view of improving the magnetic properties.

In the present embodiment, T represents one or more transition metal elements including Fe or the combination of Fe and Co. T may be Fe alone or Fe partly substituted by Co. In the case where part of Fe is substituted by Co, the temperature properties can be improved without deteriorating magnetic properties.

As an transition metal element other than Fe or the combination of Fe and Co, Ti, V, Cu, Cr, Mn, Ni, Zr, Nb, Mo, Hf, Ta, W and the like can be listed. Further, in addition to the transition metal element, T may also include at least one element of for example, Al, Ga, Si, Bi, Sn and the like.

In the R-T-B based sintered magnet of the present embodiment part of B can be substituted with carbon (C). In this case, the preparation of the magnet becomes easy and the preparation cost can be decreased. Further, the amount of C to substitute B is in an amount substantially having no effect on the magnetic properties.

In addition, O, C, Ca and the like may be inevitably mixed therein. They can be included in an amount of approximately 0.5 mass % or less each.

The main phase of the R-T-B based sintered magnet of the present embodiment is $R_2T_{14}B$ crystal grains, and the $R_2T_{14}B$ crystal grains have a crystal structure composed of $R_2T_{14}B$ type tetragonal crystal system. The average grain site of the $R_2T_{14}B$ crystal grain is generally 1 μm to 30 μm.

The grain boundary of the R-T-B based sintered magnet according to the present embodiment contains at least the R—Ga—Co—Cu—N concentrated part. In addition to the R—Ga—Co—Cu—N concentrated part, an R-rich phase having a higher concentration of R than that in the $R_2T_{14}B$ crystal grains, or a B-rich phase having a higher concentration of boron (B) than that in the $R_2T_{14}B$ crystal grains or the like may be also contained.

The content of R in the R-T-B based sintered magnet according to the present embodiment is 25 mass % or more and 35 mass % or less, preferably 29.5 mass % or more and 33 mass % or less, and more preferably 29.5 mass % or more and 32 mass % or less. When the content of R is less than 25 mass %, the generation of $R_2T_{14}B$ compound which is the main phase of the R-T-B based sintered magnet is insufficient. Thus, α-Fe having a soft magnetism may be deposited and the magnetic properties may be deteriorated. On the other hand, if the content of R exceeds 35 mass %, the volume ratio occupied by $R_2T_{14}B$ crystal grains which is the main phase of the R-T-B based sintered magnet will be decreased, and the magnetic properties may deteriorate and the corrosion resistance tends to deteriorate too.

The content of B in the R-T-B based sintered magnet according to the present embodiment is 0.5 mass % or more and 1.5 mass % or less, preferably 0.7 mass % or more and 1.2 masse or less, and the more preferably 035 mass % or more and 0.95 mass % or less. The coercivity HcJ tends to decrease if the content of B is less than 0.5 mass %, while the residual magnetic flux density Br tends to decrease when the content of B is more than 1.5 mass %. Particularly, when the content of B ranges from 0.75 mass to 0.95 mass %, it will be easy to form the R—Ga—Co—Cu—N concentrated part.

As described above, T represents one or more transition metal elements containing Fe or the combination of Fe and Co. The content of Fe in the R-T-B based sintered magnet according to the present embodiment is substantially the residual of the constituent elements for the R-T-B based sintered magnet, and Fe may be partly substituted by Co. The content of Co is preferably 0.3 mass % or more and 3.0 mass % or less, and further preferably 1.0 mass % or more and 2.0 mass % or less. If the content of Co exceeds 3.0 mass %, the residual magnetic flux density tends to deerease. Also, the R-T-B based sintered magnet of the present embodiment tends to be at a high price. On the other hand, if the content of Co is less than 0.3 mass %, it will be hard to form the R—Ga—Co—Cu—N concentrated part and the corrosion resistance tends to deteriorate. Particularly, when the content of Co ranges from 0.3 mass % to 3.0 mass %, it will be easy to fol in the R—Ga—Co—Cu—N concentrated part. In addition, Ti, V, Cr, Mn, Ni, Cu, Zr Nb, Mo, Hf, Ta, W and the like may be exemplified as the transition metal elements other than Fe or the combination of Fe and Co. Moreover, in addition to the transition metal elements, T may further include at least one element from, for example, Al, Ga, Si, Bi, Sn and the like.

The R-T-B based sintered magnet of the present embodiment contains Cu, and the content of Cu is preferably 0.01 to 1.5 mass % and more preferably 0.05 to 1.5 mass %. With the inclusion of Cu, the coercivity, corrosion resistance and temperature properties of the magnet to be obtained can be improved. In addition, if the content of Cu exceeds 1.5 mass %, the residual magnetic flux density tends to decrease. On the other hand, if the content of Cu is less than 0.01 mass % it will be hard to form the R—Ga—Co—Cu—N concentrated part and the corrosion resistance tends to deteriorate. In particular, when Cu is contained within the range of 0.05 mass % to 1.5 mass %, it will be easy to form the R—Ga—Co—Cu—N concentrated part.

The R-T-B based sintered magnet of the present embodiment contains Ga, and the content of Ga is preferably 0.01 to 1.5 mass % and more preferably 0.1 to 1.0 mass %. With the inclusion of Ga, the coercivity, corrosion resistance and temperature properties of the magnet to be obtained can be improved in addition, if the content of Ga exceeds 1.5 mass %, the residual magnetic flux density tends to decrease. On the other hand, if the content of Ga is less than 0.1 mass %, it will be hard to form the R—Ga—Co—Cu—N concentrated part and the corrosion resistance tends to deteriorate. In particular, when Ga is contained within the range of 0.1 mass % to 1.0 mass %, it will be easy to form the R—Ga—Co—Cu—N concentrated part.

In the R-T-B based sintered magnet of the present embodiment, Al is preferably contained. With Al, the coercivity, corrosion resistance and temperature properties of the magnet to be obtained can be improved. And the content of Al is preferably 0.03 mass % or more and 0.6 mass % or less, and more preferably 0.05 mass % or more and 0.25 mass % or less.

If needed, Zr may be contained in the R-T-B based sintered magnet of the present embodiment. With Zr, the grain growth can be inhibited during sintering process, and the temperature range for sintering can be enlarged. If Zr is contained, its content is preferably 0.01 mass % or more and 1.5 mass % or less.

A certain amount of oxygen (O) can be contained in the R-T-B based sintered magnet according to the present embodiment. Said certain amount varies depending on other parameters and can be suitably determined. The amount of oxygen is preferably 500 ppm or more from the viewpoint of corrosion resistance. Further, if the magnetic properties are considered, the content is preferably to be 2500 ppm or less and more preferably 2000 ppm or less.

In addition, carbon (C) can also be contained in the R-T-B based sintered magnet according to the present embodiment, and the carbon content varies depending on other parameters and can be suitably determined. However, if the content is increased, the magnetic properties will deteriorate.

The content of nitrogen (N) in the R-T-B based sintered magnet is preferably 100 to 2000 ppm, more preferably 200 to 1000 ppm, and most preferably 300 to 800 ppm. When the content of nitrogen fails within said range, it will be easy to form the R—Ga—Co—Cu—N concentrated pan. The method to add nitrogen (N) into the R-T-B based sintered magnet is not particularly restricted. For example, as described later, a raw material alloy can be introduced through a thermal treatment under as nitrogen atmosphere with a specified concentration. Alternatively, an addition agent containing nitrogen can be used as the pulverization aid. Besides, nitrogen can be introduced into the grain boundary of the R-T-B based sintered magnet by using a nitrogen-containing material as the agent to treat the raw material alloy.

The method for measuring the oxygen content, carbon content and nitrogen content in the R-T-B based sintered magnet may be conventionally well-known ones. For instance, the oxygen content may be measured by an inert gas fusion—non-dispersive infrared absorption method, the carbon content may be measured by a combustion in an oxygen airflow—infrared absorption method, and the nitrogen content may be measured by an inert as fusion—thermal conductivity method.

In the R-T-B based sintered magnet of the present embodiment, the atom number of N in the R—Ga—Co—Cu—N concentrated part within the grain boundary will account for 1 to 13% of the total atom number of R, Fe, Ga, Co, Cu and N. With such an R—Ga—Co—Cu—N concentrated part having N in the mentioned ratio, the hydrogen generated in the corrosion reaction of water and R in the R-T-B based sintered magnet can be effectively prevented from being stored into the interior R-rich phase and the corrosion of the R-T-B based sintered magnet can be prevented from progressing into the interior. In this way, the R-T-B based sintered magnet of the present embodiment may have good magnetic properties.

In another respect, in an R—Ga—Co—Cu—N concentrated part, the number of Ga atoms, Co atoms and Cu atoms respectively accounts for 7 to 16%, 1 to 9% and 4 to 8% of the total atom number of R, Fe, Ga, Co, Cu and N. When the R—Ga—Co—Cu—N concentrated part exists with elements of such ratios, the hydrogen generated in the corrosion reaction of water and R in the R-T-B based sintered magnet can be effectively prevented from being stored into the interior R-rich phase and the corrosion of the R-T-B based sintered magnet can be prevented front progressing into the interior. In this way, the R-T-B based sintered magnet of the present embodiment may have good magnetic properties.

The R-T-B based sintered magnet of the present embodiment contains in the grain boundary the R—Ga—Co—Cu—N concentrated part having higher concentrations of R, Ga, Co, Cu and N compared to those in the $R_2T_{14}B$ crystal grains. As described above, the R—Ga—Co—Cu—N concentrated part is mainly composed of R, Ga, Co, Cu and N, but other components can be further contained.

The R—Ga—Co—Cu—N concentrated part is formed in the grain boundary of the R-T-B based sintered magnet of the present embodiment. In the R-T-B based sintered magnet with no R—Ga—Co—Cu—N concentrated part, the hydrogen generated in the corrosion reaction caused by water from atmospheric water vapor or the like cannot be sufficiently prevented from being stored into the grain boundary so that the corrosion resistance deteriorates in the R-T-B based sintered magnet.

In the present embodiment, with the R—Ga—Co—Cu—N concentrated part formed in the grain boundary, the hydrogen generated in the reaction of water from such as the atmospheric water vapor intruding into the interior of the R-T-B based sintered magnet and R in the R-T-B based, sneered magnet can be effectively prevented from being stored into the whole part of the grain boundary and the corrosion of the R-T-B based sintered magnet can be prevented from progressing into the interior. In this way, the R-T-B based sintered magnet of the present embodiment may have good magnetic properties.

With respect to the corrosion development of the R-T-B based sintered magnet, the hydrogen generated in the corrosion reaction of water from such as the atmospheric water vapor and R in the R-T-B based sintered magnet is stored into the grain boundary of the R-T-B based sintered magnet, so the corrosion of the R-T-B based sintered magnet progresses inside the R-T-B based sintered magnet at an accelerated pace.

In other words, the corrosion of the R-T-B based sintered magnet progresses as follows. First of all the R-rich phase existed in the grain boundary may be easily oxidized, so R of the R-rich phase existed in a grain boundary is oxidized by the water from such as the atmospheric water vapor and thus changed into hydroxides. During this process, hydrogen is produced.

$$2R+6H_2O \rightarrow 2R(OH)_3+3H_2 \quad \text{(I)}$$

Next, the produced hydrogen is stored into the uncorroded R-rich phase, $$2R+_XH_2 \rightarrow 2RH_X \quad \text{(II)}$$

Then, the Rich phase easily corrodes due to the hydrogen storage and hydrogen is produced in an amount more than that stored in the R-rich phase due to the corrosion reaction of the R-rich phase having hydrogen stored with water.

$$2RH_X+6H_2O \rightarrow 2R(OH)_3+(3+_X)H_2 \quad \text{(III)}$$

Corrosion of the R-T-B based sintered magnet progresses inside the R-T-B based sintered magnet due to the above chain reactions (I) to (III), and the R-rich phase turns into an R hydroxide and an R hydride. Stress is accumulated by a volume expansion associated with this change, resulting in the falling off of crystal grain (the main phase grain) constituting the main phase of the R-T-B based sintered magnet. Then, a newly formed surface of the R-T-B based sintered magnet emerges due to the falling off of the crystal grains of the main phase and the corrosion of the R-T-B based sintered magnet further progresses inside the R-T-B based cratered magnet.

Therefore, the R-T-B based sintered magnet according to the present embodiment contains the R—Ga—Co—Cu—N concentrated part in the grain boundary especially in the triple junction. As the concentrated part is hard to store hydrogen, the hydrogen generated in the corrosion reaction can be prevented from being stored into the inner R-rich phase and the corrosion due to the process mentioned above can be prevented from progressing into the interior. In addition, as the R—Ga—Co—Cu—N concentrated part is harder to oxidize compared to the R-rich phase, the generation of hydrogen in the corrosion can be inhibited. Thus, the corrosion resistance of the R-T-B based sintered magnet of the present embodiment can be improved to a large extent. Further, in the present embodiment, the R-rich phase may also exist in the grain boundary. Even though the R-rich phase is existed in the grain boundary, the hydrogen can be effectively prevented from being stored into the interior R-rich phase by having the R—Ga—Co—Cu—N concentrated part. In this way, the corrosion resistance can be sufficiently improved.

As described later, in addition to the R-T-B based raw material alloy (a first alloy) mainly forming the main phase, a second alloy mainly forming the grain boundary can be added in the R-T-B based sintered magnet. Further, conditions such as the concentration of nitrogen in the atmosphere during the preparation process can be controlled for the preparation. Alternatively; a raw material which functions as the nitrogen resource can be added too if needed.

It is considered that the R—Ga—Co—Cu—N concentrated part formed in the grain boundary of the R-T-B based sintered magnet of the present embodiment is formed as follows. R, Ga, Co, and Cu, which are present in the second alloy, form a compound with nitrogen during the coarse pulverization process and/or sintering process and then appears in the grain boundary in a state of R—Ga—Co—Cu—N concentrated part.

The R-T-B based sintered magnet of the present embodiment usually can be used after being machined into any shape. The sliver of the R-T-B based sintered magnet according to the present embodiment is not particularly limited, and it may be a columnar shape such as a cuboid, a hexahedron, a tabular shape, a quadrangular prism and the like. A cross-sectional shape of the R-T-B based sintered magnet may be an arbitrary shape such as C-shaped cylindrical shape. As for as quadrangular prism, the quadrangular prism can be one with its bottom surface being a rectangle or one with the bottom surface being a square.

The R-T-B based sintered magnet according to the present embodiment includes both a magnet product in which the present magnet has been magnetized after machining and a magnet product in which the present magnet has not been magnetized.

<A Manufacturing Method of the R-T-B Based Sintered Magnet>

Figure 2:
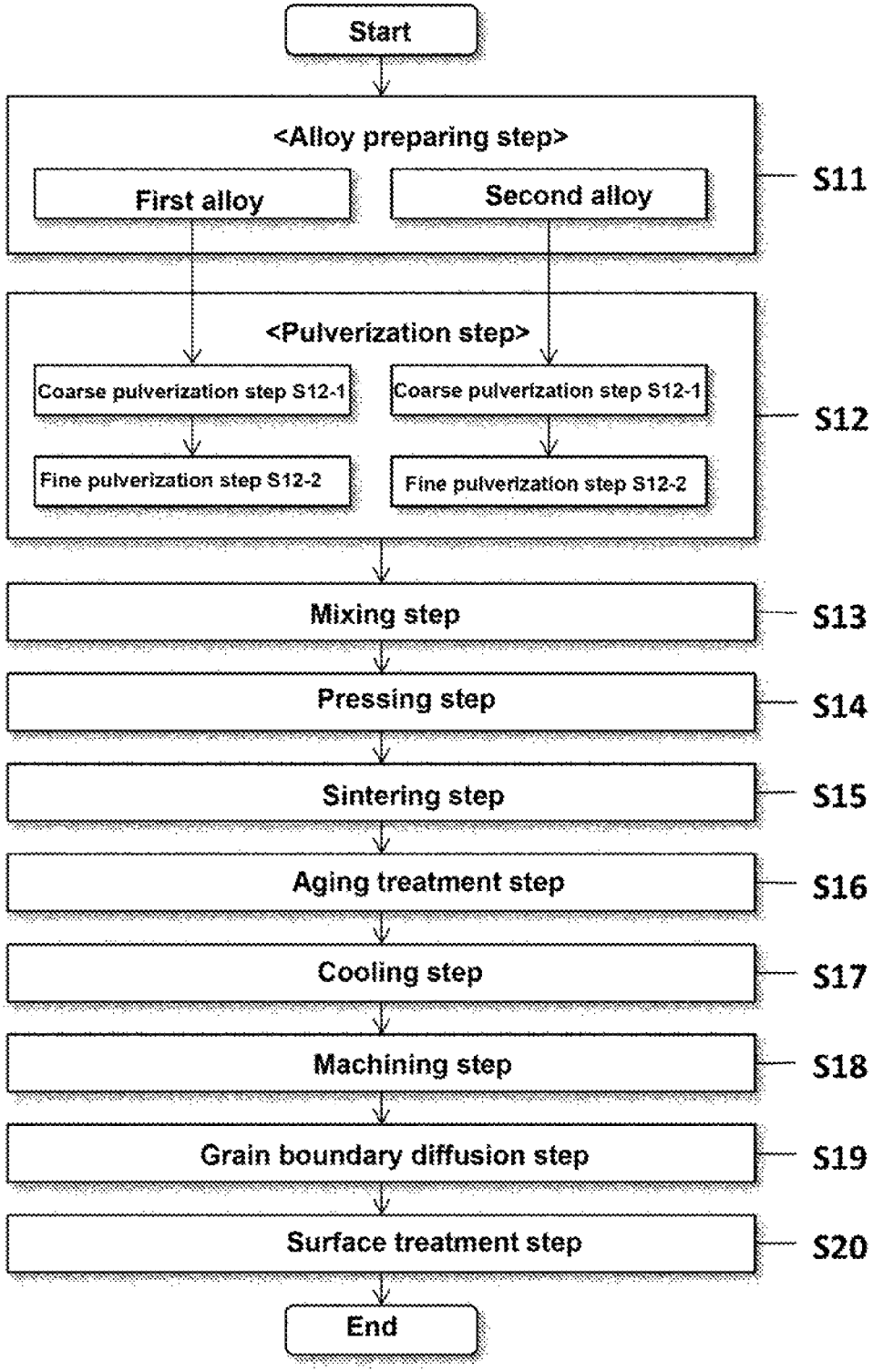
FIG. 2 is a flow chart showing an example of a method for preparing the R-T-B based sintered magnet of the present invention.

An example of the method for manufacturing the R-T-B based sintered magnet of the present embodiment with the configuration above will be described with reference to the drawings. FIG. 2 is a flow chart showing an example of the manufacturing method of R-T-B based sintered magnet according to an embodiment of the present invention. As shown in FIG. 2, a method for manufacturing the R-T-B based sintered magnet according to the present embodiment contains the following processes.

(a) AD alloy preparing step where a first alloy and a second alloy are prepared (Step S11);

(b) A pulverization step where the first alloy and the second alloy are pulverized (Step S12);

(c) A mixing step where the powder of the first alloy and the powder of the second alloy are mixed (Step S13);

(d) A pressing step where the mixed powder is pressed (Step S14);

(e) A sintering, step where the green compact is sintered to provide an R-T-B based sintered magnet (Step S15);

(f) An aging treatment step where the R-T-B based sintered magnet is subjected to an aging treatment (Step S16);

(g) A cooling step where the R-T-B based sneered magnet is cooled (Step S17);

(h) A machining step where the R-T-B based sintered magnet is machined (Step 18);

(i) A Grain boundary diffusion step where a heavy rare earth element is diffused in the grain boundary of the R-T-B based sintered magnet (Step 19));

(j) A surface treatment step where the R-T-B based sintered magnet is subjected to a surface treatment (Step 20).

[An Alloy Preparing Step: Step S11]

An alloy of the base mainly constituting the main phase (a first alloy) and an alloy of the base constituting the grain boundary (a second alloy) of the R-T-B based sintered magnet of the present embodiment are prepared (an alloy preparing step (Step S11)). In this alloy preparing step (Step S11), the raw material metals corresponding to the composition of the R-T-B based sintered magnet according to the present embodiment are melted under vacuum or in an inert gas atmosphere such as Ar gas. Then, they were casted to provide the first alloy and the second alloy each having a desired composition. A two-alloy method where the raw material powder is manufactured by mixing the two alloys (i.e., the first alloy and the second alloy) is described in the present embodiment, but a single-alloy method where to single alloy with the first alloy and the second alloy not separated may also be used.

As the raw material metal, for instance, a rare earth metal, a rare earth alloy, a pure iron, ferro-boron, and further the alloy and compound thereof can be used. A casting method for casting the raw material metals can be, for example, an ingot casting method, a strip casting method, a book molding method, a centrifugal casting method or the like. In the case where segregation occurs, the obtained raw material alloy should be homogenized when required. The homogenization of the raw material alloy is performed by keeping it under vacuum or in an inert atmosphere at a temperature of 700° C. or more and 1500° C. or less for an hour or more. Thus, the alloy for R-T-B based sintered magnet is melted and homogenized.

[A Pulverization Step: Step S12]

After the first alloy and the second alloy are manufactured, the first alloy and the second alloy are pulverized (a pulverization step (Step S12)). In this pulverization step (Step S12), after the first alloy and the second alloy are manufactured, the first alloy and the second alloy are separately pulverized to make powders. Also, the first alloy and the second alloy may be pulverized together.

The pulverization step (Step S12) includes a coarse pulverization step (Step S12-1) there the alloy is pulverized to have a particle size of several hundreds of μm to several nun and a fine pulverization step (Step S12-2) where the alloy is pulverized to have a particle size of several μm.

(A Coarse Pulverization Step (Step S12-1))

The first alloy and the second alloy are pulverized to provide a particle size of several hundreds of μm to several mm (the coarse pulverization step (Step S12-1)). In this way, the coarsely pulverized powder of the first alloy and the second alloy are thus obtained. The coarse pulverization can be performed as follows. First of all, the hydrogen is stored to the first alloy and the second alloy. Then, the hydrogen is emitted based on the difference of hydrogen storage amount among different phases. And with the dehydrogenation, a self-collapsed-type pulverization (a hydrogen storage pulverization) occurs.

The amount of nitrogen need to be added in the formation of the R—Ga—Co—Cu—N concentrated part can be regulated during the hydrogen storage pulverization of the second alloy by controlling, the concentration of nitrogen gas in the atmosphere for the dehydrogenation treatment. The suitable concentration of nitrogen gas varies depending on the composition of the raw material alloy and the like. The concentration is preferably 150 ppm or more, more preferably 200 ppm or more, and most preferably 300 ppm or more. In addition, in the hydrogen storage pulverization of the first alloy, the concentration of nitrogen gas is preferably lower than 150 ppm, more preferably 100 ppm or less, and most preferably 50 ppm or less.

Further, in addition to the hydrogen storage pulverization mentioned above, the coarse pulverization step (Step S12-1) can be performed by using a coarse pulverizer such as a stamp mill, a jaw crusher, a brown mill and the like in an inert atmosphere.

Further, in order to provide good magnetic properties, the atmosphere of each step, from the pulverization step (Step S12) to the sintering step (Step S15), is preferable with a low concentration of oxygen. The concentration of oxygen can be adjusted by controlling the atmosphere in each manufacturing process. In case the concentration of oxygen is high in each manufacturing process, the rare earth element in the powders of the first alloy and the second alloy is oxidized to generate oxides of R. The oxide of R will be deposited in the grain boundary without being reduced in the sintering process, resulting in a decreased Br in the obtained R-T-B based sintered magnet. Thus, the oxygen concentration in each process is preferably, for example, 100 ppm or less.

(A Fine Pulverization Step: Step S12-2)

After the first alloy and the second alloy are coarsely pulverized, the coarsely pulverized powders of said first alloy and said second alloy are finely pulverized to provide an average particle sue of approximately several μm (a fine pulverization step (Step S12-2)). In this way, fine pulverized powders of the first alloy and the second alloy are then obtained. A fine pulverized powder having a particle site of preferably 1 μm or more and 10 μm or less and more preferably 3 μm or more and 5 μm or less can be obtained by further finely pulverizing the coarsely pulverized powder.

Further, although the finely pulverized powder is obtained by separately pulverizing the first alloy and the second alloy in the present embodiment, the fine pulverized powder may be also obtained after mixing the coarsely pulverized powder of the first alloy and that of the second alloy in the fine pulverization step (Step S12-2).

The fine pulverization step is performed by suitably adjusting conditions such as the pulverization time and the like and at the same time performing further pulverization to the coarsely pulverized powder using a fine pulverizer such as a jet mill, a ball mill, a vibrating mill, a wet attritor and the like. The jet mill performs the following pulverization method. The jet mill discharges inert gas (e.g. $N_2$ gas) at a high pressure from a narrow nozzle to produce a high-speeded gas flow. The coarsely pulverized powder of the first alloy and the second alloy is accelerated by this high-speeded gas flow, causing a collision between the coarsely pulverized powders of the first alloy and the second alloy or a collision between the coarsely pulverized powders and a target or the wall of a container.

By adding the pulverization aids such as zinc stearate, oleic amide and the like during the fine pulverization of the coarsely pulverized powders of the first alloy and the second alloy, a finely pulverized ponder that can be oriented easily during the pressing process is obtained.

[A Mixing Step: Step S13]

After the fine pulverization of the first alloy and the second alloy, the finely pulverized powders are mixed in an atmosphere with a low concentration of oxygen (a mixing step (Step S13)). A mixed powder is then obtained. The atmosphere with a low concentration of oxygen is an inert atmosphere such as $N_2$ gas, Ar as and the like. The compounding ratio by mass of the first alloy powder to the second alloy powder is preferably 80 to 20 or more and 97 to 3 or less, and more preferably 90 to 10 or more and 97 to 3 or less.

Further, the compounding ratio of the first alloy to the second alloy when they are pulverized together in the pulverization step (Step S12) is the same as that when they are pulverized separately. The compounding ratio by mass of the first alloy powder to the second alloy powder is preferably 80 to 20 or more and 97 to 3 or less, and more preferably 90 to 10 or more and 97 to 3 or less.

In the present embodiment, the first alloy and the second alloy preferably have different compositions. For instance, the second alloy contains more Ga, Cu and Co compared to the first alloy.

The content of Ga in the second alloy is preferably 0.2% to 20% by mass, and more preferably 0.5% to 10% by mass. The first alloy may or may not contain Ga. When the first alloy also contains Ga, the content of Ga in the first alloy is preferably 0.3% or less by mass. The content of Co in the second alloy is preferably 1% to 80% by mass, and more preferably 3% to 60% by mass. The first alloy may or may not contain Co. When the first alloy also contains Co, the content of Co in the first alloy is preferably 2% or less by mass. The content of Cu in the second alloy is preferably 0.2% to 20% by mass, and more preferably 0.5% to 10% by mass. The first alloy may or may not contain Cu. When the first alloy also contains Cu, the content of Cu in the first alloy is preferably 1.0% or less by mass.

[A Pressing Step: Step S14]

After mixing the first alloy powder and the second alloy powder, the mixed powder is pressed to have a target shape (a pressing step (Step S14)). In the pressing step (Step S14), a mixed powder of the first alloy powder and the second alloy powder is filled in a press mold surrounded by an electromagnet, and then a pressure is applied thereto. In this way, the mixed powder is pressed to provide an arbitrary shape. A magnetic field is applied during that time and a predetermined orientation is produced to the raw material powder by the applied magnetic field. Then, the raw material powder is pressed with the crystal axis oriented in the magnetic field. Thus, a green compact is obtained. As the green compact is oriented in a particular direction, an anisotropic R-T-B based sintered magnet with stronger magnetism can be provided.

The pressure provided during the pressing process is preferably 30 MPa to 300 MPa. The applied magnetic field is preferably 950 kA/m to 1600 kA/m. The applied magnetic field is not limited to a magnetostatic field, and it can also be a pulsed magnetic field. In addition, a magnetostatic field and a pulsed magnetic field can be used in combination.

Further, in addition to the dry pressing method as described above where the mixed powder is pressed directly, the pressing method can also be a wet pressing where slurry obtained by dispersing the raw material powder in a solvent such as an oil is pressed.

The shape of the green compact obtained by pressing the mixed powder is not particularly limited and can be an arbitrary shape such as a cuboid, a tabular shape, a columnar shape, a ring shape and the like in accordance with the desired shape of the R-T-B based sintered magnet.

[A Sintering Step: Step S15]

The green compact pressed in a magnetic field to have a target shape is sintered under vacuum or in an men atmosphere so that an R-T-B based sintered magnet is obtained (a sintering step (Step S15)). The sintering temperature is adjusted depending on various conditions such as the composition, pulverization method, the difference of particle size and particle site distribution and the like, and the green compact is sintered by performing a thermal treatment under vacuum or in an inert atmosphere at 1000° C. or more and 1200° C. or less for an hour or more and 48 hours or less. Thus, the mixed powder produces a liquid-phase sintering, and then an R-T-B based sintered magnet (a sintered body of R-T-B based sintered magnet) is obtained with an increased volume ratio occupied by the main phase. After the green compact is sintered, the sintered both is preferably cooled rapidly so as to improve the production efficiency.

[An Aging Treatment Step: Step S16]

After the green compact is sintered, the R-T-B based sintered magnet is subjected to an aging treatment (an aging treatment step (Step S16)). After the sintering process, an aging treatment is provided to the R-T-B based sintered magnet. For example, the obtained R-T-B based sintered magnet is kept in a temperature lower than that in the sintering process. The aging treatment can be, for example, either done in two steps or in one single step. In the two-step heating treatment, the R-T-B based sintered magnet is heated at 700° C. or more and 900° C. or less for 10 minute to 6 hours and then further heated at 500° C. to 700° C. for 10 minutes to 6 hours. In the single-step heating treatment, the R-T-B based sintered magnet is heated at around 600° C. for 10 minutes to 6 hours. The treatment conditions can be suitably adjusted based on the number of times the aging treatment to be done. With such an aging treatment, the magnetic properties of the R-T-B based sintered magnet can be improved. In addition, the aging treatment step (Step S16) can be performed after a machining step (Step S18) or a grain boundary diffusion step (Step S19).

[A Cooling Step: Step S17]

After an aging treatment is provided to the R-T-B based sintered magnet, the R-T-B based sintered magnet is rapidly cooled in an Ar atmosphere (a cooling step (Step S17)). In this way, the R-T-B based sintered magnet according to the present embodiment is obtained. The cooling rate is not particularly limited, and it is preferably 30° C./min or more.

[A Machining Step: Step S18]

The obtained R-T-B based sintered magnet may be machined to have a desired shape if required to machining step: Step S18). The machining method can be for example, a shaping process such as cutting, grinding and the like, and a chamfering process such as barrel polishing and the like.

[A Grain Boundary Diffusion Step: Step S19]

A step wherein the heavy rare earth element is further diffused in a grain boundary of the machined R-T-B based sintered magnet may be performed (a Grain boundary/diffusion step: Step S19). The grain boundary diffusion is performed by attaching a compound containing the heavy rare earth element on the surface of R-T-B based sintered magnet by coating, evaporating or the like followed by a thermal treatment, or alternatively by providing a thermal treatment to the R-T-B based sintered magnet in an atmosphere containing a vapor of heavy rare earth element. With this step, the coercivity of the R-T-B based sintered magnet can be further improved.

[A Surface Treatment Step: Step S20]

A surface treatment such as plating, resin coating, oxidization treatment, chemical treatment and the like can be provided to the R-T-B based sintered magnet obtained from the steps above (a surface treatment step (Step S20)). Thus, the corrosion resistance can be further improved.

In addition, although the machining step (Step S18), the grain boundary diffusion step (Step S19) and the surface treatment step (Step S20) are performed in the present embodiment, these steps are not necessary to be performed.

As mentioned above, the R-T-B based sintered magnet according to the present embodiment is manufactured as above, and the treatments are completed. In addition, a magnet product can be obtained by magnetizing, the obtained magnet.

The thus obtained R-T-B based sintered magnet according to the present embodiment has excellent corrosion resistance as well as good magnetic properties as an R—Ga—Co—Cu—N concentrated part exists in the grain boundary.

When the R-T-B based sintered magnet of the present embodiment is used as a magnet in a rotating machine such as a motor, it can be used over a long term because of good corrosion resistance. Also, an R-T-B based sintered magnet with a high reliability can be provided. The R-T-B based sintered magnet of the present embodiment can be suitably used as a magnet in, for example, a surface permanent magnet type rotating machine with an magnet attached on the surface of a rotor, an interior permanent magnet type rotating machine such as an inner rotor type brushless motor, a PRM (permanent magnet reluctance motor) or the like. In particular, the R-T-B based sintered magnet of the present embodiment is applicable to a spindle motor for a hard disk rotating drive or a voice coil motor in a bard disk drive, a motor for an electric vehicle or a hybrid car, a motor for an electric power steering motor in an automobile, a servo motor for a machine tool, a motor for a vibrator in a cellular phone, a motor for a printer, a motor for a generator and the like.

<A Rotating Machine>

Figure 3:
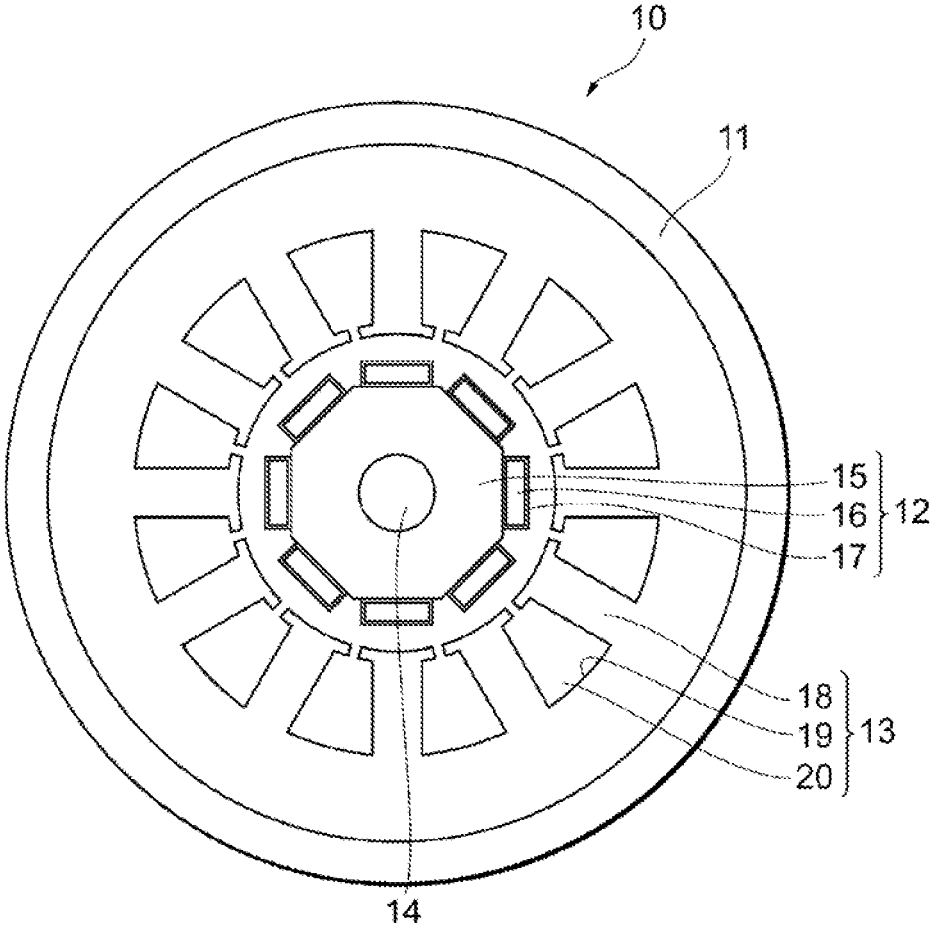
FIG. 3 is a sectional view briefly showing the configuration of one embodiment of a rotating machine.

Next, a preferable embodiment of the R-T-B based sintered magnet according to the present embodiment used in a rotating machine will be described. Here, an example of the R-T-B based sintered magnet according to the present embodiment applied to an SPM rotating machine is described. FIG. 3 is a sectional view briefly showing the configuration of an embodiment of the SPM rotating machine. As shown in FIG. 3, the SPM rotating machine 10 is provided with a columnar rotor 12, a cylindrical stator 13 and a rotary shaft 14 in a housing 11. The rotary shaft 14 goes through the center of cross-section of rotor 12.

The rotor 12 is provided with a columnar rotor core (iron core) 15 composed of iron and the like, a plurality of permanent magnets 16 arranged with a predetermined spacing on the outer peripheral surface of the rotor core 15 and a plurality of magnet insertion slots 17 taking in the permanent magnets 16. The R-T-B based sintered magnet according to the present embodiment is used as the permanent magnet 16. A plurality of permanent magnets 16 are arranged in each magnet insertion slot 17 with the N-pole and the S-pole deposited alternately in a circumferential direction of the rotor 12. Thus, permanent magnets 16 adjacent in the circumferential direction generate magnetic field lines in mutually reversed directions along the radial direction of rotor 12.

The stator 13 is provided with a plurality of stator cores 18 and throttles 19 arranged with a predetermined spacing in a circumferential direction of the inner side of its cylindrical wall (peripheral wall) along the outer peripheral surface of the rotor 12. The plurality of stator cores 18 are arranged so as to be directed toward the stator 13 and opposed to the rotor 12. Further, a coil 20 is wound around inside each throttle 19. The permanent magnet 16 and the stator core 18 are arranged to the each other.

The rotor 12 together with the rotary shalt 14 is installed in an inner space inside the stator 13 in a rotatable way. The stator 13 provides torque to the rotor 12 via an electromagnetic action so that the rotor 12 rotates in the circumferential direction.

The SPM rotating machine 10 uses the R-T-B based sintered magnet according to the present embodiment as the permanent magnet 16. The permanent magnet 16 shows corrosion resistance while exhibiting good magnetic properties. Thus, the SPM rotating machine 10 is thus capable of improving the properties of the rotating machine such as the torque characteristic and also showing a high output power for a long term. In this respect, it is excellent in reliability.

The present invention will not be limited to the embodiment above, and various modifications are available within the scope of the present invention.

EXAMPLES

Hereinafter, examples will be listed to illustrate the present invention in more details. However, the present invention will not be limited to the following examples.

Example 1

First of all, raw material alloys were prepared by a strip casting method which can provide a sintered magnet with a composition I as shown in Table 1. As the raw material alloys, a first alloy A mainly constituting the main phase of the magnet and to second alloy a mainly constituting the grain boundary were respectively prepared in accordance with the composition as shown in Table 1. In addition, in Table 1 (also applicable to Table 2), bal. referred to the residual amount when the total composition was deemed as 100 mass % in each alloy, and (T.RE) represented the sum of the rare earth elements (mass %).

TABLE 1

| | Composition (mass %) | | | | | | | | | |
|---|---|---|---|---|---|---|---|---|---|---|
| | Nd | Dy | (T. RE) | Co | Ga | Al | Cu | B | Fe | Mass ratio |
| First alloy A | 30.00 | 0.00 | 30.00 | 0.50 | 0.00 | 0.20 | 0.00 | 0.95 | bal. | 95 |
| Second alloy a | 30.00 | 20.00 | 50.00 | 10.00 | 6.00 | 0.20 | 3.00 | 0.00 | bal. | 5 |
| Magnet composition I | 30.00 | 1.00 | 31.00 | 0.98 | 0.30 | 0.20 | 0.15 | 0.90 | bal. | |

Next, after hydrogen was stored to each of the raw material alloys at room temperature, the first alloy was subjected to a dehydrogenation process at 600° C. for an hour in an Ar atmosphere to perform the hydrogen pulverization treatment (coarse pulverization). Meanwhile, the second alloy was also subjected to a dehydrogenation process at 600° C. for an hour in an Ar atmosphere with 300 ppm of nitrogen gas to perform the hydrogen pulverization treatment (coarse pulverization). Particularly, a hydrogen pulverization treatment was done to the second alloy in an Ar atmosphere having some nitrogen gas so as to react the second alloy with nitrogen.

In addition, in the present example, each step, from the hydrogen pulverization treatment to the sintering process, the fine pulverization and pressing process) was done in an Ar atmosphere with the oxygen concentration therein being lower than 50 ppm (same conditions were applied in the following examples and comparative examples).

Next, for each alloy, after the hydrogen pulverization and before the fine pulverization, 0.1 wt % of zinc stearate was added to the coarsely pulverized powder as a pulverization aid. Then, the mixture was mixed by a Nauta mixer. And then, a jet mill was used to perform the fine pulverization so as to provide a finely pulverized, powder having an average particle size of around 4.0 μm.

Subsequently, the obtained finely pulverized powder of the first alloy and that of the second alloy were mixed in a mass ratio of 95:5 by a Nauta mixer so that a mixed powder of the raw material powder of the R-T-B based sintered magnet was prepared.

The obtained mixed powder was filled in a press mold arranged in an electromagnet, and the powder was pressed under an applied pressure of 120 MPa in a magnetic field of 1200 kA/m. In this way, the green compact was obtained.

After that, the green compact was sintered under vacuum at 1060° C. for 4 hours and then rapidly cooled to provide a sintered body (the R-T-B based sintered magnet) having the composition I as shown in Table 1. Next, a two-step aging treatment was performed to the obtained sintered body at 850° C. for one hour and then at 540° C. for 2 hours (both in an Ar atmosphere). In this respect, the R-T-B based sintered magnet of Example 1 was obtained.

Example 2

An R-T-B based sintered magnet of Example 2 was obtained as in Example 1 except that a second alloy b having the composition as shown in Table 2 was used as the raw material alloy to prepare a sintered magnet with a magnet composition II as shown in Table 2.

TABLE 2

| | Composition (mass %) | | | | | | | | | |
|---|---|---|---|---|---|---|---|---|---|---|
| | Nd | Dy | (T. RE) | Co | Ga | Al | Cu | B | Fe | Mass ratio |
| First alloy A | 30.00 | 0.00 | 30.00 | 0.50 | 0.00 | 0.20 | 0.00 | 0.95 | bal. | 95 |
| Second alloy b | 30.00 | 20.00 | 50.00 | 20.00 | 9.00 | 0.20 | 5.00 | 0.00 | bal. | 5 |
| Magnet composition II | 30.00 | 1.00 | 31.00 | 1.48 | 0.45 | 0.20 | 0.25 | 0.90 | bal. | |

Comparative Example 1

An R-T-B based sintered magnet of Comparative Example 1 was obtained as in Example 1 except that a second alloy was subjected to a hydrogen pulverization treatment in an Ar atmosphere without nitrogen gas.

<Assessment>

[Composition Analysis]

A composition analysis was performed on the R-T-B based sintered Magnets obtained in Examples 1 and 2 and Comparative Example 1 by an X-ray fluorescence analysis and an inductively coupled plasma mass spectrometry (ICP-MS). As a result, it was confirmed that any one of these R-T-B based sintered magnets had a composition substantially the same as the composition of the added raw materials (the compositions as shown in Table 1 and Table 2).

[Assessment on Structure]

For the R-T-B based sintered magnet obtained in Examples 1 and 2 and Comparative Example 1, a surface of a cross-section was milled by an ion milling to remove the influence related to the oxidation in the outermost surface or the like, and then the element distribution in the cross-section of the R-T-B based sintered magnet was observed by EPMA (Electron Probe Micro Analyzer) followed by an analysis. In particular, each element including Nd, Ga, Co, Cu and N was mapping analyzed in an area of 50 μm×50 μm and the part where the distribution concentration of each element including Nd, Ga, Co, Cu and N was higher than that in the main phase grains was observed.

As a result, the presence of a part where the distribution concentration of each element including Nd, Ga, Co, Cu and N was higher than that in the main phase grains the R—Ga—Co—Cu—N concentrated part) was confirmed in the grain boundary in the R-T-B based sintered magnet of Examples 1 and 2. However, no R—Ga—Co—Cu—N concentrated part was found in the grain boundary of the R-T-B based sintered magnet of Comparative Example 1.

Further, in the R-T-B based sintered magnet in Examples 1 and 2 where the R—Ga—Co—Cu—N concentrated part was observed in the grain boundary, the R—Ga—Co—Cu—N concentrated part (5 points) and the crystal grain of the main phase (1 point) were respectively subjected to a quantitative analysis by EPMA. The results were shown in Table 3.

Further, the composition ratio in the table referred to the ratio of each element when the total atom number of Nd, Fe, Ga, Co, Cu and N was deemed as 100.

TABLE 3

| | | Composition ratio (%) | | | | | |
|---|---|---|---|---|---|---|---|
| | | Nd | Fe | Ga | Co | Cu | N |
| Example 1 | Grain boundary phase Point 1 | 60 | 13 | 12 | 5 | 6 | 4 |
| | Grain boundary phase Point 2 | 59 | 12 | 12 | 6 | 6 | 5 |
| | Grain boundary phase Point 3 | 58 | 14 | 11 | 5 | 7 | 5 |
| | Grain boundary phase Point 4 | 59 | 14 | 11 | 5 | 8 | 3 |
| | Grain boundary phase Point 5 | 58 | 15 | 9 | 7 | 5 | 6 |
| | Main phase | 13 | 86 | 0 | 1 | 0 | 0 |
| Example 2 | Grain boundary phase Point 1 | 58 | 13 | 15 | 5 | 6 | 3 |
| | Grain boundary phase Point 2 | 58 | 16 | 13 | 5 | 6 | 2 |
| | Grain boundary phase Point 3 | 58 | 12 | 16 | 6 | 6 | 3 |
| | Grain boundary phase Point 4 | 60 | 11 | 14 | 7 | 7 | 1 |
| | Grain boundary phase Point 5 | 58 | 15 | 15 | 4 | 7 | 3 |
| | Main phase | 13 | 85 | 0 | 2 | 0 | 0 |

As shown in Table 3, in the quantitative analysis by EPMA, it was also confirmed in the R-T-B based sintered magnet of Examples 1 and 2 that a part where the concentration distribution of each element including Nd, Ga, Co, Cu and N was higher than that in the main phase grains (the R—Ga—Co—Cu—N concentrated part) existed in the grain boundary.

[Magnetic Properties]

The magnetic properties of the R-T-B based sintered magnet obtained in Examples 1 and 2 and Comparative Example 1 were measured by a B-H tracer. The residual magnetic flux density Br and the coercivity HcJ were measured as the magnetic properties. The results were shown in Table 4.

[Corrosion Resistance]

The R-T-B based sintered magnets obtained in Examples 1 and 2 and Comparative Example 1 were machined as plates of 13 mm×8 mm×2 mm. These tabular magnets were placed in an atmosphere of saturated water vapor with 100% relative humidity and 2 atm at 120° C. The weight loss due to corrosion was assessed. The results were shown in Table 4.

TABLE 4

| | Magnetic properties | | Weight loss after saturation type PCT |
|---|---|---|---|
| | Br (mT) | HcJ (kA/m) | (Pressure Cooker Test) for 200 hours (mg/cm$^2$) |
| Example 1 | 1371 | 1542 | 1.4 |
| Example 2 | 1365 | 1594 | 0.6 |
| Comparative Example 1 | 1369 | 1532 | 21.3 |

As shown in Table 4, the R-T-B based sintered magnet from Examples 1 and 2 had equivalent magnetic properties as that in the R-T-B based sintered magnet from Comparative Example 1. Also, it had been determined that the R-T-B based sintered magnet from Examples 1 and 2 had the corrosion resistance highly improved compared to the magnet in Comparative Example 1.

Example 3

An R-T-B based sintered magnet of Example 3 was obtained as in Example 1 except that a first alloy C and a second alloy c having the composition as shown in Table 5 were used as the raw material alloys to prepare a sintered magnet with a magnet composition III as shown in Table 5.

TABLE 5

| | Composition (mass %) | | | | | | | | | | | |
|---|---|---|---|---|---|---|---|---|---|---|---|---|
| | Nd | Pr | Dy | (T. RE) | Co | Ga | Al | Cu | Zr | B | Fe | Mass ratio |
| First alloy C | 23.50 | 6.50 | 0.00 | 30.00 | 0.00 | 0.00 | 0.03 | 0.00 | 1.67 | 1.05 | bal. | 90 |
| Second alloy c | 30.00 | 10.00 | 0.00 | 40.00 | 15.00 | 8.00 | 0.03 | 4.00 | 0.00 | 0.00 | bal. | 10 |
| Magnet composition III | 24.15 | 6.85 | 0.00 | 31.00 | 1.50 | 0.80 | 0.03 | 0.40 | 1.50 | 0.95 | bal. | |

Example 4

An R-T-B based sintered magnet of Example 4 was obtained as in Example 1 except that a first alloy D and a second alloy d having the composition as shown in Table 6 were used as the raw material alloys to prepare a sintered magnet with a magnet composition IV as shown in Table 6.

TABLE 6

| | Composition (mass %) | | | | | | | | | | | |
|---|---|---|---|---|---|---|---|---|---|---|---|---|
| | Nd | Pr | Dy | (T. RE) | Co | Ga | Al | Cu | Zr | B | Fe | Mass ratio |
| First alloy D | 25.20 | 7.02 | 0.00 | 32.22 | 1.67 | 0.22 | 0.10 | 1.00 | 0.00 | 0.83 | bal. | 90 |
| Second alloy d | 30.00 | 10.00 | 0.00 | 40.00 | 15.00 | 8.00 | 0.10 | 6.00 | 0.00 | 0.00 | bal. | 10 |
| Magnet composition IV | 25.68 | 7.32 | 0.00 | 33.00 | 3.00 | 1.00 | 0.30 | 1.50 | 0.00 | 0.75 | bal. | |

Example 5

An R-T-B based sintered magnet of Example 5 was obtained as in Example 1 except that a first alloy E and a second alloy e having the composition as shown in Table 7 were used as the raw material alloys to prepare a sintered magnet with a magnet composition V as shown in Table 7.

TABLE 7

| | Composition (mass %) | | | | | | | | | | | |
|---|---|---|---|---|---|---|---|---|---|---|---|---|
| | Nd | Pr | Dy | (T. RE) | Co | Ga | Al | Cu | Zr | B | Fe | Mass ratio |
| First alloy E | 29.00 | 0.00 | 0.20 | 29.20 | 0.00 | 0.00 | 0.62 | 0.00 | 0.10 | 0.95 | bal. | 97 |
| Second alloy e | 40.00 | 0.00 | 0.00 | 40.00 | 10.00 | 3.20 | 0.10 | 1.80 | 0.00 | 0.00 | bal. | 3 |
| Magnet composition V | 29.33 | 0.00 | 0.19 | 29.52 | 0.30 | 0.10 | 0.60 | 0.05 | 0.10 | 0.92 | bal. | |

Example 6

An R-T-B based sintered magnet of Example 6 was obtained as in Example 1 except that a first alloy F and a second alloy f having the composition as shown in Table 8 were used as the raw material alloys to prepare a sintered magnet with a magnet composition VI as shown in Table 8.

TABLE 8

| | Composition (mass %) | | | | | | | | | | | |
|---|---|---|---|---|---|---|---|---|---|---|---|---|
| | Nd | Pr | Dy | (T. RE) | Co | Ga | Al | Cu | Zr | B | Fe | Mass ratio |
| First alloy F | 23.70 | 7.90 | 0.00 | 31.60 | 0.20 | 0.10 | 0.25 | 0.00 | 0.40 | 0.88 | bal. | 95 |
| Second alloy f | 30.00 | 10.00 | 0.00 | 40.00 | 15.00 | 10.00 | 0.25 | 6.00 | 0.00 | 0.00 | bal. | 5 |
| Magnet composition VI | 24.02 | 8.01 | 0.00 | 32.02 | 0.94 | 0.60 | 0.25 | 0.30 | 0.38 | 0.84 | bal. | |

Comparative Example 2

An R-T-B based sintered magnet of Comparative Example 2 was obtained as in Example 3 except that a second alloy c was subjected to a hydrogen pulverization treatment in an Ar atmosphere without nitrogen gas.

Comparative Example 3

An R-T-B based sintered magnet of Comparative Example 3 was obtained as in Example 4 except that a second alloy d was subjected to as hydrogen pulverization treatment in an Ar atmosphere without nitrogen gas.

Comparative Example 4

An R-T-B based sintered magnet of Comparative Example 4 was obtained as in Example 5 except that a second alloy e was subjected to a hydrogen pulverization treatment in an Ar atmosphere without nitrogen gas.

Comparative Example 5

An R-T-B based sintered magnet of Comparative Example 5 was obtained as in Example 6 except that a second alloy f was subjected to a hydrogen pulverization treatment in an Ar atmosphere without nitrogen gas.

<Assessment>

[Composition Analysis]

A composition analysis was performed on the R-T-B based sintered magnets obtained in Examples 3 to 6 and Comparative Examples 2 to 5 by an X-ray fluorescence analysis and an inductively coupled plasma mass spectrometry (ICP-MS method). As a result, it was confirmed that any one of these R-T-B based sintered magnets had a composition substantially the same as the composition of the added raw materials (the compositions as shown in Table 5 to Table 8).

[Assessment on Structure]

For the R-T-B based sintered magnets obtained in Examples 3 to 6 and Comparative Examples 2 to 5, a surface of a cross-section was milled by an ion milling to remove the influence caused by the oxidation in the outermost surface or the like, and then the element distribution in the cross-section of the R-T-B based sintered magnet was observed by EPMA (Electron Probe Micro Analyzer) followed by an analysis particular, each element including Nd, Ga, Co, Cu and N was mapping analyzed in an area of 50 μm×50 μm, and the part where the distribution concentration of each element including Nd, Ga, Co, Cu and N was higher than that in the main phase grains was observed.

As a result, the presence of the part where the distribution concentration of each element including Nd, Ga, Co, Cu and N was higher than that in the main phase grains the R—Ga—Co—Cu—N concentrated part) in the grain boundary was confirmed in the R-T-B based sintered magnets of Examples 3 to 6. However, no R—Ga—Co—Cu—N concentrated part was found in the grain boundary of the R-T-B based sintered magnets of Comparative Examples 2 to 5.

Further, in the R-T-B based sintered magnets in Examples 3 to 6 where the R—Ga—Co—Cu—N concentrated part was observed in the grain boundary the R—Ga—Co—Cu—N concentrated part (5 points) and the crystal grain of the main Phase (1 point) were respectively subjected to a quantitative analysis by EPMA. The results were shown in Table 9.

Further, the composition ratio in the table referred to the ratio of each element when the total atom number of Nd, Pr, Dy, Fe, Ga, Co, Cu and N was deemed as 100.

TABLE 9

| | | Composition ratio (%) | | | | | |
|---|---|---|---|---|---|---|---|
| | | Nd + Pr + Dy | Fe | Ga | Co | Cu | N |
| Example 3 | Grain boundary phase Point 1 | 57 | 7 | 10 | 7 | 6 | 13 |
| | Grain boundary phase Point 2 | 58 | 10 | 9 | 6 | 5 | 12 |
| | Grain boundary phase Point 3 | 56 | 9 | 11 | 8 | 4 | 12 |
| | Grain boundary phase Point 4 | 57 | 8 | 11 | 7 | 6 | 11 |
| | Grain boundary phase Point 5 | 59 | 7 | 10 | 9 | 5 | 10 |
| | Main phase | 13 | 85 | 0 | 2 | 0 | 0 |
| Example 4 | Grain boundary phase Point 1 | 65 | 8 | 11 | 8 | 6 | 2 |
| | Grain boundary phase Point 2 | 64 | 9 | 12 | 7 | 5 | 3 |
| | Grain boundary phase Point 3 | 65 | 10 | 10 | 6 | 7 | 2 |
| | Grain boundary phase Point 4 | 63 | 7 | 11 | 8 | 7 | 4 |
| | Grain boundary phase Point 5 | 68 | 10 | 10 | 6 | 5 | 1 |
| | Main phase | 13 | 84 | 0 | 3 | 0 | 0 |
| Example 5 | Grain boundary phase Point 1 | 61 | 17 | 8 | 1 | 6 | 7 |
| | Grain boundary phase Point 2 | 61 | 15 | 9 | 1 | 5 | 9 |
| | Grain boundary phase Point 3 | 62 | 16 | 10 | 1 | 5 | 6 |
| | Grain boundary phase Point 4 | 61 | 18 | 7 | 1 | 5 | 8 |
| | Grain boundary phase Point 5 | 62 | 16 | 8 | 1 | 6 | 7 |
| | Main phase | 13 | 87 | 0 | 0 | 0 | 0 |
| Example 6 | Grain boundary phase Point 1 | 59 | 13 | 12 | 5 | 6 | 5 |
| | Grain boundary phase Point 2 | 60 | 13 | 11 | 5 | 5 | 6 |
| | Grain boundary phase Point 3 | 60 | 11 | 10 | 8 | 7 | 4 |
| | Grain boundary phase Point 4 | 59 | 15 | 11 | 4 | 4 | 7 |
| | Grain boundary phase Point 5 | 58 | 14 | 11 | 6 | 6 | 5 |
| | Main phase | 13 | 86 | 0 | 1 | 0 | 0 |

As shown in Table 9, in the quantitative analysis by EPMA, it was also confirmed in the R-T-B based sintered magnets of Examples 3 to 6 that a part where the concentration distribution of each element including R (sum of Nd, Pr and Dy), Ga, Co, Cu and N was higher than that in the main-phase grains (the R—Ga—Co—Cu—N concentrated part) existed in the grain boundary.

[Magnetic Properties]

The magnetic properties of the R-T-B based sintered magnets obtained in Examples 3 to 6 and Comparative Examples 2 to 5 were measured by a B-H tracer. The residual magnetic flux density Br and the coercivity HcJ were measured as the magnetic properties. The results were shown in Table 10.

[Corrosion Resistance]

The R-T-B based sintered magnets obtained in Examples 3 to 6 and Comparative Examples 2 to 5 were machined as plates of 13 mm×8 mm×2 mm. The tabular magnets were placed in an atmosphere of saturated water vapor with 100% relative humidity and 2 atm at 120° C. The weight loss due to corrosion was assessed. The results were shown in Table 10.

TABLE 10

| | Magnetic properties | | Weight loss after saturation type PCT |
|---|---|---|---|
| | Br (mT) | HcJ (kA/m) | (Pressure Cooker Test) for 200 hours (mg/cm$^2$) |
| Example 3 | 1338 | 1320 | 1.0 |
| Example 4 | 1286 | 1432 | 2.1 |
| Example 5 | 1401 | 1192 | 1.2 |
| Example 6 | 1345 | 1580 | 0.6 |
| Comparative Example 2 | 1335 | 1306 | 13.6 |
| Comparative Example 3 | 1281 | 1420 | 22.6 |
| Comparative Example 4 | 1398 | 1170 | 14.2 |
| Comparative Example 5 | 1340 | 1565 | 10.7 |

As shown in Table 10, the R-T-B based sintered magnets from Examples 3 to 6 had equivalent magnetic properties as those in the R-T-B based sintered magnets from Comparative Examples 2 to 5. Also, it had been determined that both the R-T-B based sintered magnets from Examples 1 and 2 had the corrosion resistance highly improved compared to the magnets in Comparative Examples 2 to 5.

DESCRIPTION OF REFERENCE NUMERALS

2 grains (main phase)
4 a two-grain boundary
6 a triple junction
10 an SPM rotating machine
11 a housing
12 a rotor
13 a stator
14 a rotary shaft
15 a rotor core(iron core)
16 a permanent magnet
17 a magnet insertion slot
18 a stator core
19 a throttle
20 a coil

What is claimed is:

1. An R-T-B based sintered magnet comprising $R_2T_{14}B$ crystal grains, and a grain boundary formed between or among two or more adjacent $R_2T_{14}B$ crystal grains, Ga in an amount in a range of from 0.1 mass % to 1.0 mass %, Co in an amount in a range of from 0.3 mass % to 3.0 mass %, Cu in an amount in a range of from 0.05 mass % to 1.5 mass %, N, and Zr in an amount in a range of from 0.01 mass % to 1.5 mass %, wherein R represents at least one rare earth element and a content of R in the R-T-B based sintered magnet is in a range of from 29.5 mass % to 33 mass %, T represents one or more transition metal elements comprising Fe or a combination of Fe and Co, a content of B in the R-T-B based sintered magnet is in a range of from 0.75mass % to 0.95 mass %, the grain boundary contains R—Ga—Co—Cu—N concentrated parts, each of which is a single, continuous area within the grain boundary in which concentrations of R, Ga, Co, Cu, and N are higher than those in the $R_2T_{14}B$ crystal grains respectively, the R—Ga—Co—Cu—N concentrated parts are separate from an R-—rich phase in the grain boundary, a number of Ga atoms in the R—Ga—Co—Cu—N concentrated part is in a range of from 7 to 16% of a total atom number of R, Fe, Ga, Co, Cu, and N, a number of Co atoms in the R—Ga—Co—Cu—N concentrated part is in a range of from 1 to 9% of a total atom number of R, Fe, Ga, Co, Cu, and N, a number of Cu atoms in the R—Ga—Co—Cu—N concentrated part is in a range of from 4 to 8% of a total atom number of R, Fe, Ga, Co, Cu, and N, and a number of N atoms in the R—Ga—Co—Cu—N concentrated part is in a range of from 1 to 13% of a total atom number of R, Fe, Ga, Co, Cu, and N.

2. A rotating machine comprising the R-T-B based sintered magnet of claim 1.

* * * * *